US005807146A

United States Patent [19]

Baker

[11] Patent Number: 5,807,146

[45] Date of Patent: Sep. 15, 1998

[54] RADIO FREQUENCY COAXIAL TRANSMISSION LINE INNER CONDUCTOR CONNECTION SYSTEM

[75] Inventor: Robert S. Baker, Harrison, Me.

[73] Assignee: Howell Laboratories, Inc., Bridgton, Me.

[21] Appl. No.: 816,343

[22] Filed: Mar. 13, 1997

[51] Int. Cl.[6] ..... H01R 13/17

[52] U.S. Cl. ..... 439/827; 439/948

[58] Field of Search ..... 439/827, 737, 439/32, 738, 823, 948

[56] References Cited

U.S. PATENT DOCUMENTS

| | | | |
|---|---|---|---|
| 3,818,421 | 6/1974 | Kruger | 439/827 X |
| 4,128,293 | 12/1978 | Paoli | 439/827 X |

FOREIGN PATENT DOCUMENTS

| | | | |
|---|---|---|---|
| 2622-361 A | 4/1989 | France | 439/827 OR |
| 3187168 A | 8/1991 | Japan | 439/827 OR |

*Primary Examiner*—Neil Abrams
*Assistant Examiner*—Daniel Wittels
*Attorney, Agent, or Firm*—Samuels, Gauthier, Stevens & Reppert

[57] ABSTRACT

A two component connection system consisting of a female connector and a male connector. The female connector consists of three components joined together with a bolt. First is a cup that has the same inner and outer diameters as the tubing that forms the rest of the inner conductor. Second is a bushing stepped diametrically in three places. The first step accepts a standard anchor insulator. The second step is the same diameter as the outside of the inner conductor tubing. The third step has a diameter that allows it to fit snugly inside of the inner conductor tubing. The male connector consists of a cylinder with a bushing on one end that allows it to be assembled to inner conductor tubing and a diameter on the other end with a tandem pair of glands for watchband style springs that fits inside of the female connector cup. The cup of the female connector is fixed in position relative to the outer conductor by the captured anchor insulator.

9 Claims, 3 Drawing Sheets

RADIO FREQUENCY COAXIAL TRANSMISSION LINE INNER CONDUCTOR CONNECTION SYSTEM

FIELD OF THE INVENTION

The invention relates to radio frequency coaxial transmission line and in particular to a connection system that provides an electrical connection for the inner conductor.

BACKGROUND AND BRIEF SUMMARY OF THE INVENTION

With coaxial transmission line used to carry radio frequency energy, it is always desirable to make a solid electrical connection at the inner conductor junction where different sections of line are mechanically joined together. A common method of producing this connection is a two ended connector made of silver plated brass that has finger contacts sprung with an internal style snap ring on one end, an anchor insulator in the middle, and a watchband style spring contained within a rectangular cross section gland formed radially upon the cylinder of the connector. This assembly is typically mechanically captured by the inner conductor such that the watchband style spring side of the connector can move through a stroke of about ¼ of an inch without being physically removed from the inner conductor. The capture mechanism typically provides a physical plug that prevents wear products from the watchband style spring from migrating through the inside of the inner conductor and contaminating the mechanical connection at the other end. In a typical coaxial transmission line run, each section has a connector assembly, as described, at one end and an open piece of inner conductor tube forming a female connection at the other end. When the line is assembled, Electronic Industries Association style flanges on the outer conductor are bolted together and capture the anchor insulating preventing it from moving in relation to the line which in turn prevents the connector from moving. The finger side of the connector is inserted into the female side of the inner conductor of the mating piece of line with sufficient insertion force to insure that the finger side does not move during differential expansion, only the watchband style connection moves. The connector is typically oriented with the finger side pointing up in a vertical run of transmission line. This insures that the wear products from the watchband style spring connection stay inside of the inner conductor and do not contaminate the inside of the transmission line.

It is the object of the invention to make a solid electrical connection at the inner conductor junction while allowing for differential expansion of said inner conductor and eliminating the internal snap ring sprung fingers of the typical expansion connector.

The object of the invention is attained by a two component connection system consisting of a female connector with an anchor insulator and a male connector with a tandem pair of watchband style springs contained within rectangular cross section glands formed radially upon the cylinder of the male connector. In a vertical run of transmission line the female connector is oriented pointing up and mates with the male connector oriented pointing down.

Broadly, the invention comprises a two-component connection system. A sleeve-like female connector has an inner surface, an outer surface, a floor and an open end. A conductive tube is secured to the female connector. A sleeve-like male connector has an outer surface and an alignment end. The male connector is adapted to be slidably received in the female connector. The outer surface of the male connector spaced apart from the inner surface of the female connector and the outer surface of the male connector is characterized by at least one annular recess. A flexible conductor is received in the recess to provide electrical communication between the male connector and the female connector. The outer surface of the male connector is further characterized by a limit step to engage the end of the female sleeve to maintain the alignment end spaced apart from the floor of the female connector. A chamber is defined therebetween.

A conductive tube is secured to the male connector whereby as there is relative movement between the male and female connectors wear products are received in the chamber.

In the preferred embodiment, the female connection comprises three components joined together with a bolt. The first component is a cup formed of oxygen-free, high conductivity copper or the like that has the same inner and outer diameters as the tubing that forms the rest of the inner conductor. The depth of the cup is sufficient to fit the male connector and allow for the motion of differential expansion. The base is at least twice as thick as the walls with a clearance hole in the center for the joining bolt. The second component is a bushing that is stepped diametrically in three places. The first step is of a length and diameter to accept a standard anchor insulator. The second step is the same diameter as the outside of the inner conductor tubing and is of sufficient length to allow for the weld that joins the bushing to the inner conductor tubing. The third step has a diameter that allows it to fit snugly inside of the inner conductor tubing and a length long enough to keep the bushing axially aligned with the tubing during the welding process. The bushing contains a threaded hole centered on its axis that mates with the joining bolt. The third component is an anchor insulator constructed of polytetrafluoroethylene or the like and of standard dimensions.

The male connector comprises a cylinder of oxygen-free, high conductivity copper or the like with a bushing detail on one end similar to that of the female connector bushing that allows it to be assembled to the inner conductor tubing and be welded in place. It also has a diameter on the other end with a tandem pair of glands for watchband style springs that fits inside of the female connector cup. The insertion end of the male connector has a 60° included angle taper to aid the insertion portion of assembly.

Assembly of the two halves of the connection system occurs when two transmission line sections are joined together. As the two transmission line sections are aligned and merged, the male connector is guided into the cup of the female connector. In the assembled configuration, the cup of the female connector is fixed in position relative to the outer conductor by the captured anchor insulator. The male connector at the other end of the inner conductor is free to move axially as the inner conductor expands and contracts relative to the outer conductor. Wear products caused by this motion gather harmlessly in the bottom of the cup.

My invention provides a solid electrical connection of the inner conductor, allows for differential expansion and accomplishes this with fewer mechanical connections and less parts than the prior art.

DESCRIPTION OF THE PREFERRED EMBODIMENT(S)

Figure 1:
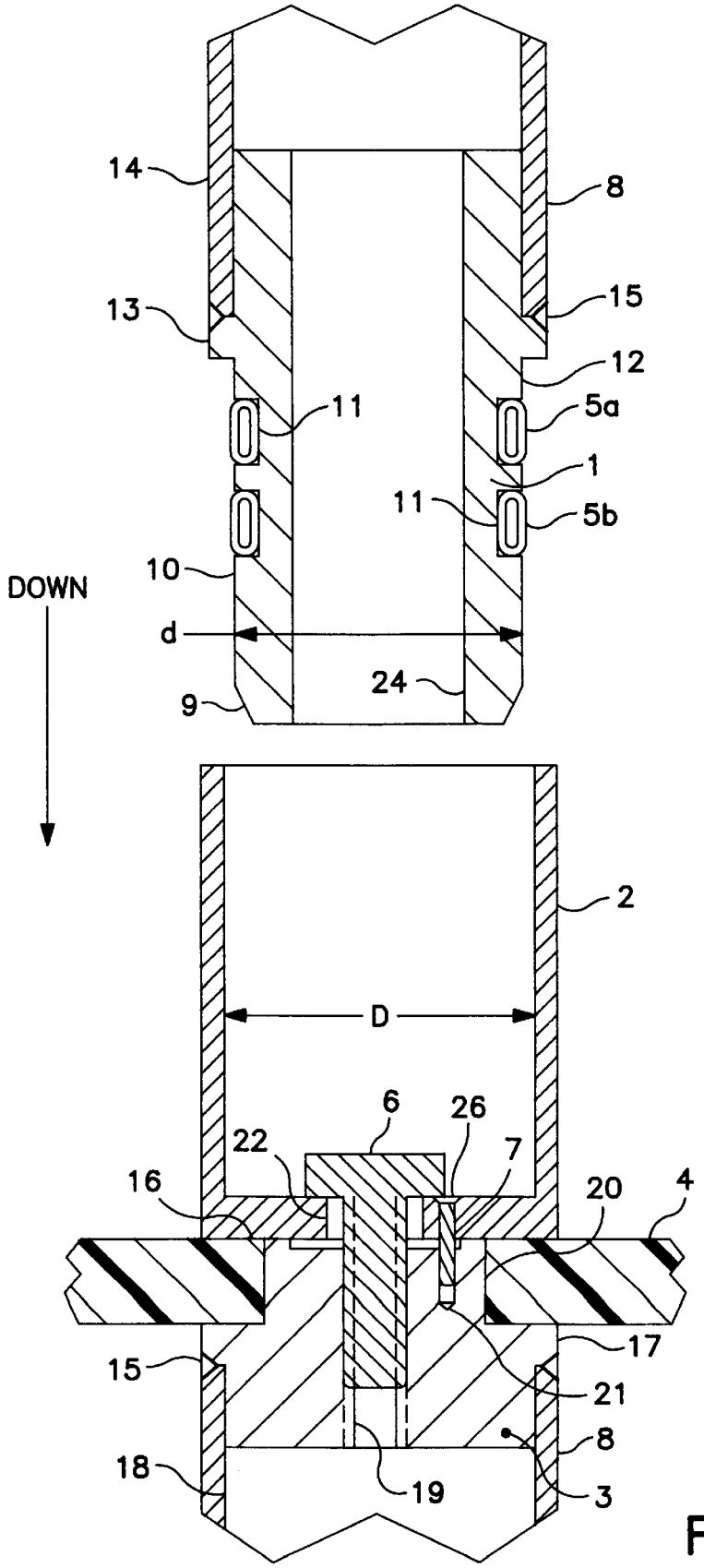
FIG. 1 is a sectional view of two halves of a connection system embodying the invention in an unconnected state.

Referring to FIG. 1, a connection system in accordance with the invention takes the form of a male connector 1, a female connector cup 2, a bushing 3 and an anchor insulator 4. The male connector 1 is constructed of oxygen-free, high conductivity copper or the like and has a central hole 24 to reduce weight and to allow venting during the welding operation that joins the pieces of the inner conductor together. A 60° included angle taper 9 is machined on the bottom to correct for angular misalignments during assembly. This taper 9 is followed by an alignment sleeve 10 to further reduce angular misalignments once initial engagement occurs. Diameter "d" is sized to give an all around clearance of approximately 0.010 inch when inserted into the female connector cup 2 with an inner diameter "D".

Two annular recesses or glands 11 are adapted to receive two watchband style springs 5*a* and 5*b*. The top watchband style spring 5*a* carries the majority of the radio frequency current and makes the primary electrical contact. The bottom watchband style spring 5*b* provides mechanical alignment and secondarily carries a small portion of the radio frequency current. An expansion relief section 12 allows for movement of the male connector 1 during differential expansion. A shoulder 13, the same diameter as an inner conductor tube 8, is provided to axially locate the male connector 1 and allow for the weld 15 which is used to join the male connector 1 to the inner conductor tube 8. A tube lead 14 is sized for a snug fit in the inner conductor tube 8 and provides angular alignment of the male connector 1 to the inner conductor tube 8.

The female connector cup 2 is also made from oxygen-free, high conductivity copper or the like and is in the form of an annular cylinder with a flat bottom that has a central through hole 22 for a bolt 6 and a smaller off center hole 26 that accepts an anti-rotation pin 7 made of stainless steel or the like. The female connector cup 2 is secured to the bushing 3 by means of a bolt 6 and is kept from turning during assembly by the anti-rotation pin 7. The hole 26 for the anti-rotation pin 7 located in the female connector cup 2 has a slip fit to the anti-rotation pin 7. The hole 21 for the anti-rotation pin 7 in the bushing 3 is designed for a press fit of the anti-rotation pin 7 to keep it in place during assembly.

The bushing 3 is made of oxygen-free, high conductivity copper or the like and has a contact surface 16 on its top face to provide sufficient contact pressure between the female connector cup 2 and the bushing 3. An undercut 20 is provided to capture the anchor insulator 4 and to compensate for its dielectric constant so that there is a continuous impedance. A shoulder 17, the same diameter as the inner conductor tube 8, is provided to axially locate the bushing 3 and allow for the weld 15 which is used to join the bushing 3 to the inner conductor tube 8. A tube lead 18 is sized for a snug fit in the inner conductor tube 8 and provides angular alignment of the bushing 3 to the inner conductor tube 8. An on center axial threaded hole 19 is provided to mate with the bolt 6 during assembly.

The anchor insulator 4 is a typical Electronic Industries Association style insulator in the form of an annular disc formed of polytetrafluoroethylene or the like with a central hole that fits snugly on the undercut 20 of the bushing 3. Typically a small hole of approximately ¼ inch in diameter is provided in the face of the anchor insulator 4 to allow for the movement of pressurizing gas.

Figure 2:
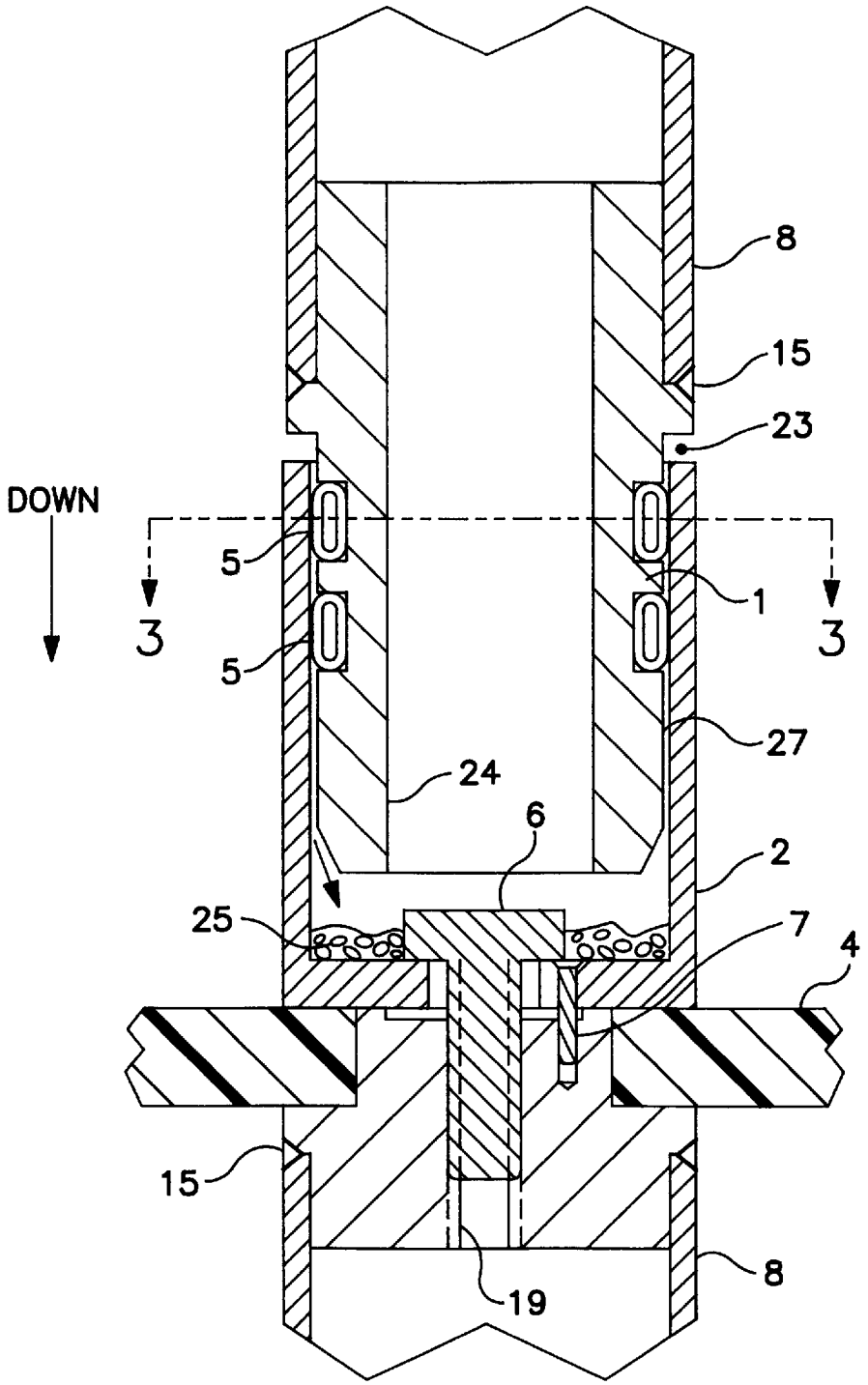
FIG. 2 is a sectional view of two halves of FIG. 1 in a connected state.

Referring to FIG. 2, the connection system is shown in its connected state with the male connector 1 engaged in the female connector cup 2 such that a small gap 23 of approximately ⅛ of an inch is left between the shoulder 13 of the male connector 1 and the top of the female connector cup 2. This allows sufficient room for axial motion of the male connector 1 in relation to the female connector cup 2 during differential expansion. When assembled, a small axial gap 27 of approximately 0.010 inch radially, occurs between the male connector 1 and the female connector cup 2. This insures that electrical contact is maintained solely by the watchband style springs 5. Wear products 25 in the form of powdered silver plating from the watchband style springs 5 flow down from the male connector 1 through the gap 27 and gather harmlessly on the inside bottom of the female connector cup 2.

Figure 3:
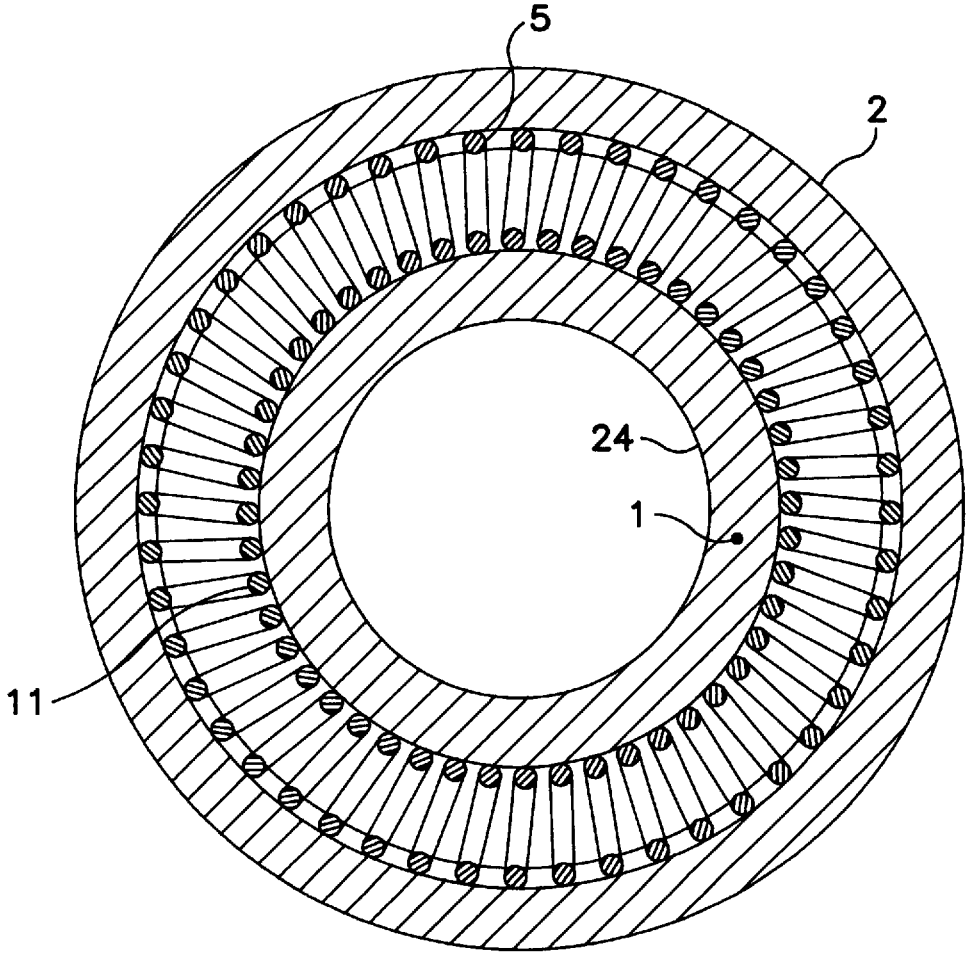
FIG. 3 is a sectional view of FIG. 2 taken along lines 3—3.

FIG. 3 illustrates the connection between the male connector 1 and the female connector cup 2 via the watchband style spring 5*a* received in the gland 11.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A two-component connection system for joining conductive tubes comprising:

a three component, sleeve-like female connector having: a first cup-like component, an inner surface, an outer surface, a floor and an open end, the floor characterized by an aperture for a fastener to pass therethrough;

a second component comprising a bushing stepped in three places, the bushing having an upper and a lower surface, the upper surface adapted to abut the bottom of the first cup-like component, the first step formed in the bushing extending from the upper surface of the bushing toward the lower surface and shaped to receive an insulator, the second step intermediate the upper and lower ends of the bushing and of the same diameter as the outside diameter of conductive tubing to be secured thereto and a third step extending from the lower surface toward the second step and of a diameter allowing conductive tubing to be received thereover:

a sleeve-like male connector having an outer surface and an alignment end, said male connector adapted to be slidably received in the female connector, the outer surface of the male connector spaced apart from the inner surface of the female connector, the outer surface of the male connector characterized by at least one annular recess, a flexible conductor received in the recess to provide electrical communication between the male connector and the female connector, the outer surface of the male connector further characterized by a limit step to engage the end of the female sleeve to maintain the alignment end spaced apart from the floor of the female connector and defining a chamber therebetween;

a fastener to secure the female connector to the bushing, said fastener passing through the aperture in the floor of the cup-like component and into the bushing; and means for securing a conductive tube to the male connector, whereby as there is relative movement between the male and female connectors wear products are received in the chamber.

2. The connection system of claim 1 comprising:

means to secure a conductive bushing having an outer surface to the floor of the female connector.

3. The connection system of claim 1 comprising:

means to secure a conductive tube to the second stepped portion of the bushing.

4. The connection system of claim 3 wherein the outer surface of the conductive tube, the outer surface of the bushing and the outer surface of the female connector all lie in the same plane.

5. The connection system of claim 3 comprising:

an insulator received in the annular recess.

6. The connection system of claim 1 wherein the means to secure the bushing to the female connector comprises:

means to threadingly engage one to the other.

7. The connection system of claim 6 comprising:

means for preventing relative rotation of the female connector to the bushing during assembly.

8. The connection system of claims 1, 2, 3, 4, or 5, wherein the male connector is characterized by a second annular recess formed in the outer wall, said second annular spaced apart from and in parallel relationship with the first annular recess; and a flexible conductor is received in said second recess.

9. The connection system of claim 8 wherein the outer surface of the male connector comprises a second step, the conductive tube engages said second step whereby the outer surface of the conductive tube secured to the male connector, the outer surface of the female connector, the outer surface of the bushing and the outer surface of the conductive tube secured to the female connector all lie in the same plane.

* * * * *